US010800005B2

(12) United States Patent
Spinner et al.

(10) Patent No.: US 10,800,005 B2
(45) Date of Patent: Oct. 13, 2020

(54) SHOT PEENING TOOLS AND RELATED METHODS

(71) Applicant: SUPERIOR SHOT PEENING, INC., Houston, TX (US)

(72) Inventors: Daniel Spinner, Houston, TX (US); Van Blasingame, Houston, TX (US); Albert Johnson, Houston, TX (US)

(73) Assignee: Superior Shot Peering, Inc., Houston, TX (US)

( * ) Notice: Subject to any disclaimer, the term of this patent is extended or adjusted under 35 U.S.C. 154(b) by 263 days.

(21) Appl. No.: 15/812,460

(22) Filed: Nov. 14, 2017

(65) Prior Publication Data

US 2018/0065229 A1 Mar. 8, 2018

Related U.S. Application Data

(62) Division of application No. 15/174,303, filed on Jun. 6, 2016, now Pat. No. 9,844,852.

(51) Int. Cl.

| | |
|---|---|
| ***B21D 31/06*** | (2006.01) |
| ***B24C 1/10*** | (2006.01) |
| ***C21D 7/06*** | (2006.01) |
| ***C22F 1/00*** | (2006.01) |
| ***B24C 3/32*** | (2006.01) |

(52) U.S. Cl.

CPC ..... *B24C 1/10* (2013.01); *B24C 3/325* (2013.01); *C21D 7/06* (2013.01); *C22F 1/00* (2013.01)

(58) Field of Classification Search

CPC .. B21D 31/06; C21D 7/06; B24C 1/10; B23P 9/04; B24B 39/02

See application file for complete search history.

(56) References Cited

U.S. PATENT DOCUMENTS

| | | | | |
|---|---|---|---|---|
| 3,485,073 | A * | 12/1969 | Burney | B24C 1/10 72/53 |
| 4,354,371 | A | 10/1982 | Johnson | |
| 4,428,213 | A | 1/1984 | Neal et al. | |
| 4,706,356 | A | 11/1987 | Bianchi et al. | |
| 5,107,631 | A | 4/1992 | Wern | |
| 5,531,570 | A | 7/1996 | Mannava et al. | |
| 5,794,474 | A | 8/1998 | Willoughby et al. | |
| 6,079,244 | A | 6/2000 | Robinson et al. | |
| 6,845,552 | B2 | 1/2005 | Blough | |
| 8,065,898 | B2 | 11/2011 | Nardi et al. | |
| 9,027,375 | B2 | 5/2015 | Hennig et al. | |
| 9,314,833 | B2 | 4/2016 | Higuchi et al. | |
| 2009/0071214 | A1 | 3/2009 | Matsuo | |
| 2010/0037976 | A1 | 2/2010 | Toyotake et al. | |
| 2011/0233926 | A1 | 9/2011 | Carcagno et al. | |
| 2012/0255634 | A1 | 10/2012 | Pendleton | |
| 2014/0048182 | A1 | 2/2014 | Furukawa et al. | |
| 2016/0130679 | A1 | 5/2016 | Cober et al. | |

* cited by examiner

*Primary Examiner* — Debra M Sullivan

(74) *Attorney, Agent, or Firm* — Gregory L. Porter; Hunton Andrews Kurth LLP

(57) ABSTRACT

A tool for cold-working a metal substrate of a longitudinal bore having a diameter less than about eight inches includes a deflector tip configured to direct accelerated shot having diameters on average not larger than 100 mils (2.54 mm) toward a surface of the metal substrate at an angle between about 70 degrees and about 85 degrees relative to the surface, thereby providing increased compressive stresses in the metal substrate.

10 Claims, 3 Drawing Sheets

SHOT PEENING TOOLS AND RELATED METHODS

CROSS-REFERENCES

This application is a divisional application of U.S. Ser. No. 15/174,303, filed Jun. 6, 2016, which was allowed on Aug. 23, 2017.

FIELD

Embodiments disclosed herein relate to shot peening tools and related methods of shot peening metal surfaces. Embodiments disclosed herein further relate to methods of achieving greater compressive stresses at greater depths beneath surfaces of metal substrates, or greater shot peened coverage over a metal surface, or both.

BACKGROUND AND SUMMARY

Mechanical surface treatments cold-work the surface material, causing compressive residual stresses and, depending on the properties of the materials, often strengthening the surface against strain. One of the most common and versatile of the cold-working treatments is "shot peening." In shot peening, the surface is bombarded with high-velocity shot, round metallic, glass or ceramic beads, discharged from a pneumatic nozzle. The resulting lightly hammered or "peened" effect places the surface in residual, preferably uniform, compression. In one aspect, embodiments disclosed herein relate to [to be completed when claims are final]

BRIEF DESCRIPTION OF THE DRAWINGS

The invention is illustrated in the accompanying drawings wherein.

DETAILED DESCRIPTION

Figure 1:
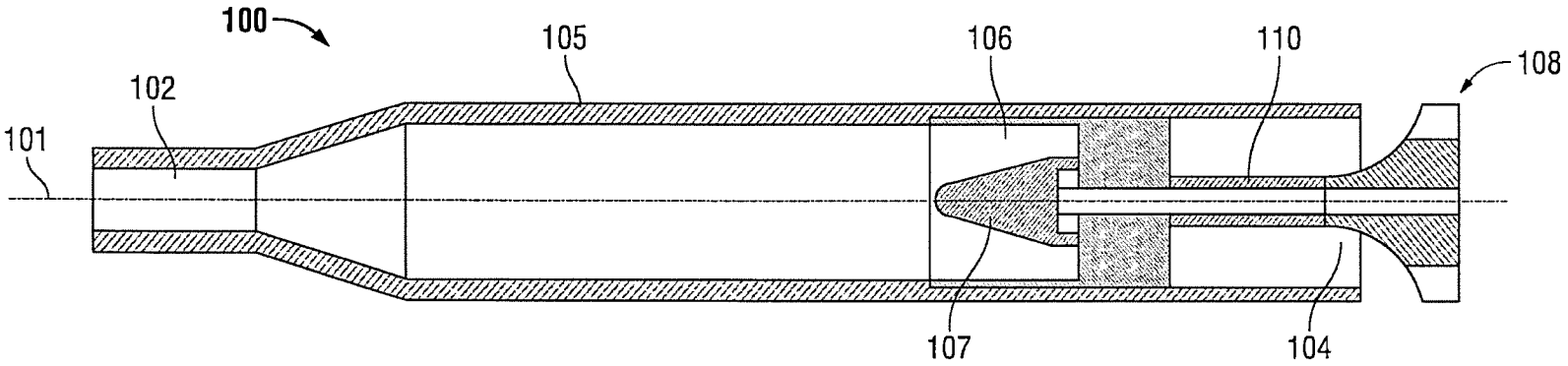
FIG. 1 illustrates a section view of a shot peening tool in accordance with one embodiment.

Shot peening tools and related methods for shot peening any type of metal substrate are disclosed. Shot peening is used to finish metal parts that require increased wear and fatigue resistance. In the process, shot bombards the surface of the metal substrate, creating small dimples in the surface. The number of dimples may be referred to as "coverage", a measurement that defines the number of impacts as a percentage of the surface having dimples from shot impact. For example, one hundred percent (100%) coverage means that one hundred percent (100%) of every square inch of surface has been impacted leaving a dimple. Shot may have many different diameters or average diameters, and may be spherical or non-spherical, that is, diameter is not limited to meaning spherical shot. The dimples cause compressive stresses in the surface and sub-surface of the substrate, increasing the metal substrate's resistance to cracks, fatigue, and corrosion. Shot peening may be used for a wide variety of parts including threads of all kinds, inner diameter (ID) bores and outer diameter (OD) flex points, crankshafts, gears, torsion bars, springs, valves, exhaust manifolds, blades, discs, turbines, compressors, marine rudders, axles, hammers and anvils, bicycle frames, landing gear, boat hulls, drill bits, pipelines, mud motors, concrete pumps, fracking pumps, boiler tubes, and other oil and gas equipment.

Shot peening and blast finishing equipment may include horizontal or vertical work holding fixtures, in some instances mounted to rotating or non-rotating lances or units, loading and unloading mechanisms, and adjustable media feed and air pressure, and fixed or flexible shot peening tools. Shot peening equipment may include motorized, reciprocating lances with speed control to shot peen the inner diameter surfaces of equipment being worked, e.g., fluid ends. This assures that the application of the shot is uniform, and as such leaves repeatable, uniform compression. Shot peening tools disclosed herein are configured to traverse inner volumes of equipment to shot peen internal metal surfaces at various locations. For example, internal bores, threads, sealing areas, seats, packing areas, cavities, and all types of radii, chamfers, and intersections are among the internal locations that may be shot peened using the tool.

In one embodiment, the shot peening tool includes a venturi nozzle and a deflector tip configured to distribute accelerated shot radially outward in a 360-degree pattern. The venturi nozzle may have an inner diameter opening of at least about ⅛ inch (3.175 mm), or at least about ¼ inch (6.35 mm), or at least about ½ inch (12.7 mm), or at least about ¾ inch (19.05 mm), up to about 1 inch (25.4 mm), or up to about 1¼ inches (31.75 mm), or up to about 1½ inches (38.1 mm), or up to about 2 inches (50.8 mm), or up to about 2½ inches (63.5 mm), or greater. The deflector tip may be disposed at a distal end of a throat rod that extends longitudinally through the venturi nozzle. The deflector tip is positioned longitudinally beyond an exit opening of the nozzle and configured to direct the shot exiting the nozzle radially outward at the metal surface in a 360-degree pattern. An angled surface of the deflector tip may be between about 45 degrees and about 90 degrees relative to the metal surface being impinged upon. In another embodiment, the angled surface of the deflector tip may be between about 65 degrees and about 85 degrees. In yet another embodiment, the angled surface of the deflector tip may be between about 70 degrees and about 80 degrees. The tool includes internal components comprising carbide having an abrasion resistance greater than about 40 HRC (measured on the Rockwell hardness scale), or greater than about 50 HRC, or greater than about 60 HRC.

Shot peening tools disclosed herein may be attached to a rotating or non-rotating pipe lance or other structure and connected to an air hose and air supply for providing pneumatic force. The tool is inserted into the equipment to be worked, a blast machine is started, and the tool is pushed through the equipment. An air pressure source may provide air pressure of at least about 50 psi (344.74 kPa), or at least about 60 psi (413.69 kPa), or at least about 70 psi (482.63 kPa), or at least about 80 psi (551.58 kPa), or at least about 90 psi (620.53 kPa), up to about 100 psi (689.48 kPa), or up to about 110 psi (758.42 kPa), or up to about 120 psi (827.37 kPa), or up to about 130 psi (896.32 kPa), or up to about 140 psi (965.27 kPa), or greater. The air pressure source is configured to feed and propel the shot at a suitable velocity through the venturi nozzle to impact the deflector tip and thereby impart compressive stresses in the metal surface. Shot contacts the deflector tip and is directed radially outwardly in a 360-degree pattern to impact the metal substrate. Compressed air blows shot out of the equipment being worked.

Generally, lower shot feed rates may be used for shot peening smaller, more confined spaces. For example, shot is fed through the tool at about less than one pound per minute up to six pounds per minute for shot peening smaller internal diameters. For example, smaller internal diameters may be at least 0.5 inches (12.7 mm), or 0.6 inches (15.24 mm), or 0.7 inches (17.78 mm), or 0.8 inches (20.32 mm), or 0.9 inches (22.86 mm), or 1.0 inch (25.4 mm), and up to about 2 inches (50.8 mm), or 2.1 inches (53.34 mm), or 2.2 inches (55.88 mm), or 2.3 inches (58.42 mm), or 2.4 inches (60.96 mm), or 2.6 inches (66.04 mm), or 3 inches (76.2 mm), or greater. Shot may be fed through the tool at about three pounds per minute up to about six pounds per minute for shot peening larger internal diameters, for example, larger internal diameters of at least 2 inches (50.8 mm), or at least 2.5 inches (63.5 mm), or at least 3 inches (76.2 mm), or at least 3.5 inches (88.9 mm), or at least 4 inches (101.6 mm), and up to 5 inches (127 mm), and up to 6 inches (152.4 mm), and up to 7 inches (177.8 mm), up to 8 inches (203.2 mm), and up to 10 inches (254 mm), and up to 15 inches (381 mm), and up to 20 inches (508 mm), and up to 30 inches (762 mm), and up to 40 inches (1,016 mm), or greater. The tool traverses internally within the equipment being worked at a speed adequate to impart proper compressive stresses in the metal surface and reduce or avoid shot-on-shot interference which may degrade the peening results.

Shot diameters may range from at least about 1 mil (0.0254 mm), or at least about 3 mils (0.0762 mm), or at least about 5 mils (0.127 mm), or at least about 10 mils (0.254 mm), or at least about 20 mils (0.508 mm), or at least about 30 mils (0.762 mm), or at least about 40 mils (1.016 mm). Shot diameters may further range up to about 50 mils (1.27 mm), or up to about 60 mils (1.524 mm), or up to about 70 mils (1.778 mm), or up to about 80 mils (2.032 mm), or up to about 90 mils (2.286 mm), or up to about 100 mils (2.54 mm), or greater.

Shot may be any material, including metal such as but not limited to stainless steel, cast carbon steel, steel grit, non-ferrous grit, and aluminum oxide grit. Shot may further comprise a high degree of hardness and density which create even greater compressive stresses beneath the metal surface. For example, shot may comprise a hardness of at least 55 HRC, or at least 60 HRC, or at least 65 HRC, and up to 68 HRC, or up to 70 HRC, or up to 72 HRC, or up to 74 HRC, or greater.

In some instances, smaller diameter shot may comprise a greater hardness to offset the lack of mass and maintain or even increase the elasticity of collision with a metal substrate. For example, a shot diameter of 3 mils or less may comprise a hardness of up to 65 HRC, or up to 68 HRC, or up to 70 HRC, or up to 74 HRC, or greater. In another example a shot diameter of 6 mils or less may comprise a hardness of up to 65 HRC, or up to 68 HRC, or up to 70 HRC, or up to 74 HRC, or greater. In yet another example, a shot diameter of 10 mils or less may comprise a hardness of up to 65 HRC, or up to 68 HRC, or up to 70 HRC, or up to 74 HRC, or greater. Shot may also be other materials such as ceramic or glass.

Moreover, different shot diameter combinations may be used to provide greater compressive stresses beneath a metal surface in conjunction with a smoother external metal surface. Larger shot may create a rougher surface that is less desirable for fluid flow over that surface in that it creates turbulence. For example, fracking fluids may contain acids, particulate material called "proppants" such as silica sand (extremely abrasive), or polymeric spheres that also cause turbulence. Turbulence may create varying pressures on the surfaces of the intersecting radii, which may increase abrasion of the metal surface. In certain instances, after a larger diameter shot has been used to create the deepest compressive stresses beneath the metal surface, a smaller diameter shot may be used over the same surface to "smooth" out the surface, that is, decrease peak-to-valley profile of the metal surface profile.

In one example, larger shot diameter ranging between 50 mils (1.27 mm) and 100 mils (2.54 mm) in one embodiment, or between 60 mils (1.524 mm) and 90 mils (2.286 mm) in another embodiment, or between 70 mils (1.778 mm) and 80 mils (2.032 mm) in yet another embodiment, may be used in one or more passes over the metal surface in different or the same directions to create the deepest compressive stresses beneath the metal surface. Subsequently, smaller shot diameter ranging between 10 mils (0.254 mm) and 50 mils (1.27 mm) in one embodiment, or between 20 mils (0.508 mm) and 40 mils (1.016 mm) in another embodiment, or between 25 mils (0.635 mm) and 35 mils (0.889 mm) in yet another embodiment, may be used in one or more passes over the metal surface in different or the same directions to smooth out the metal surface. Surface roughness average (Ra) achieved by using the smaller diameter shot may be equal to or less than 200 Ra, or equal to or less than 190 Ra, or equal to or less than 185 Ra, or equal to or less than 180 Ra. The smoother metal surface creates less turbulence and therefore abrasive wear on radii surfaces may be decreased.

FIG. 1 illustrates a section view of a shot peening tool in accordance with one embodiment. The shot peening tool 100 includes an outer cylindrical housing 105 having a longitudinal axis 101. The housing 105 has an inlet opening 102 at a first end and an exit opening 104 at a second end. The tool 100 includes a venturi nozzle 106 configured to accelerate velocities of shot within the housing 105. The venturi nozzle 106 may be formed between a conical tip 107 aligned with the longitudinal axis 101 and an inner wall of the outer housing 105. The tool further includes a deflector tip 108 configured to distribute the accelerated shot radially outward in a 360-degree pattern. The deflector tip 108 is disposed at a distal end of a throat rod 110 that extends longitudinally through the outer housing 105. The deflector tip 108 is positioned longitudinally beyond the exit opening 104 of the tool and configured to direct the shot exiting radially outward at the metal surface in a 360-degree pattern. An angled surface of the deflector tip 108 may be between about 45 degrees and about 90 degrees relative to the metal surface being impinged upon. In another embodiment, the angled surface of the deflector tip 108 may be between about 65 degrees and about 85 degrees. In yet another embodiment, the angled surface of the deflector tip 108 may be between about 70 degrees and about 85 degrees.

Figure 2A:
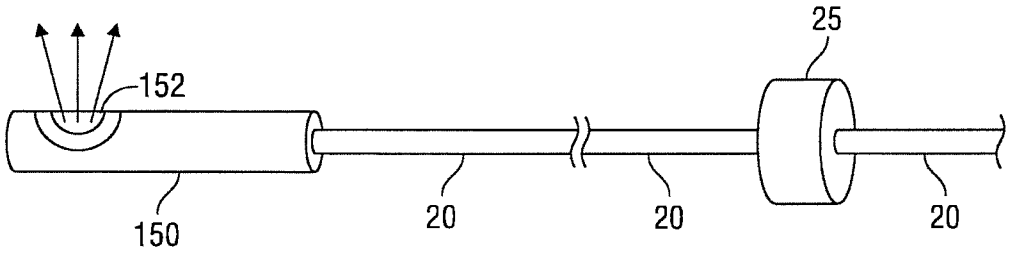
FIG. 2A illustrates a perspective view of a shot peening tool in accordance with an alternate embodiment.
Figure 2B:
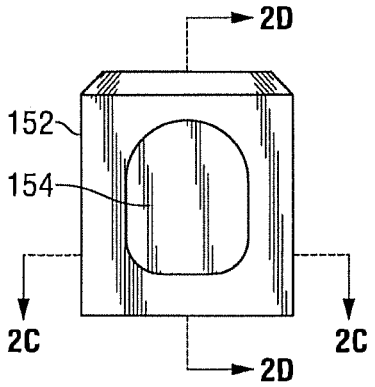
FIGS. 2B-E illustrate different views of a deflector nozzle used with the shot peening tool of FIG. 2A.
Figure 2C:
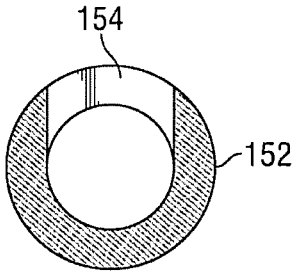
Figure 2D:
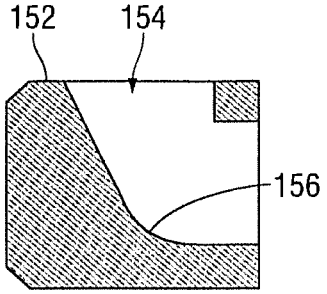
Figure 2E:
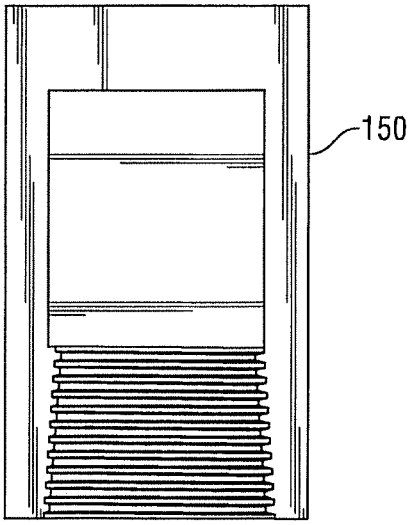

FIG. 2A illustrates a perspective view of a shot peening tool in accordance with an alternate embodiment. The shot peening tool 150 may be disposed at an end of a rotating lance 20. The shot peening tool 150 includes a rotatable deflector nozzle 152 that, when rotated, is configured to distribute accelerated shot radially outward in a certain direction (indicated by arrows) and at an angle of incidence to a surface of the metal substrate being shot peened. FIG. 2B illustrates a top view of the deflector nozzle 152. FIG. 2E illustrates a holder or carrier 151 in which the deflector nozzle 152 is disposed and secured. The carrier 151 may be attached to an end of the lance 20 (FIG. 2), e.g., threaded. FIGS. 2C and 2D illustrate different section views taken from FIG. 2B of the deflector nozzle 152. Referring to FIGS. 2B-D, the deflector nozzle 152 includes an opening 154 on a side to allow accelerated shot to exit from the deflector nozzle 152. The deflector nozzle 152 further includes a curved or substantially curved or angled radius 156 therein for deflecting the shot outward.

The shot impacts the metal surface at angles of incidence between about 45 degrees and about 90 degrees relative to the metal surface being impinged upon. In another embodiment, the shot impacts the surface at angles of between about 65 degrees and about 85 degrees. In yet another embodiment, the shot impacts the metal surface at angles between about 70 degrees and about 85 degrees. Shot is conveyed by high pressure air through the shot peening tool 150 to impart the required depth of compressive stresses to all pertinent areas of the inner diameter sections of the equipment being worked. Shot is mixed with compressed air at a pressure pot, and then pneumatically conveyed through a hose to a steel lance 20. The steel lance 20 has a powered rotating coupling 25 that rotates the end of the lance with the shot peening tool 150 and deflector nozzle 152 that may be rotated 360 degrees allowing the shot to be delivered in a continuous 360 degree rotation. The deflector nozzle 152 creates a flow of high velocity shot that can impact all areas. The rotating lance 20 may be run through the inner diameter bores from both ends of the bore via a mechanized lance drive (not shown).

Figure 3A:
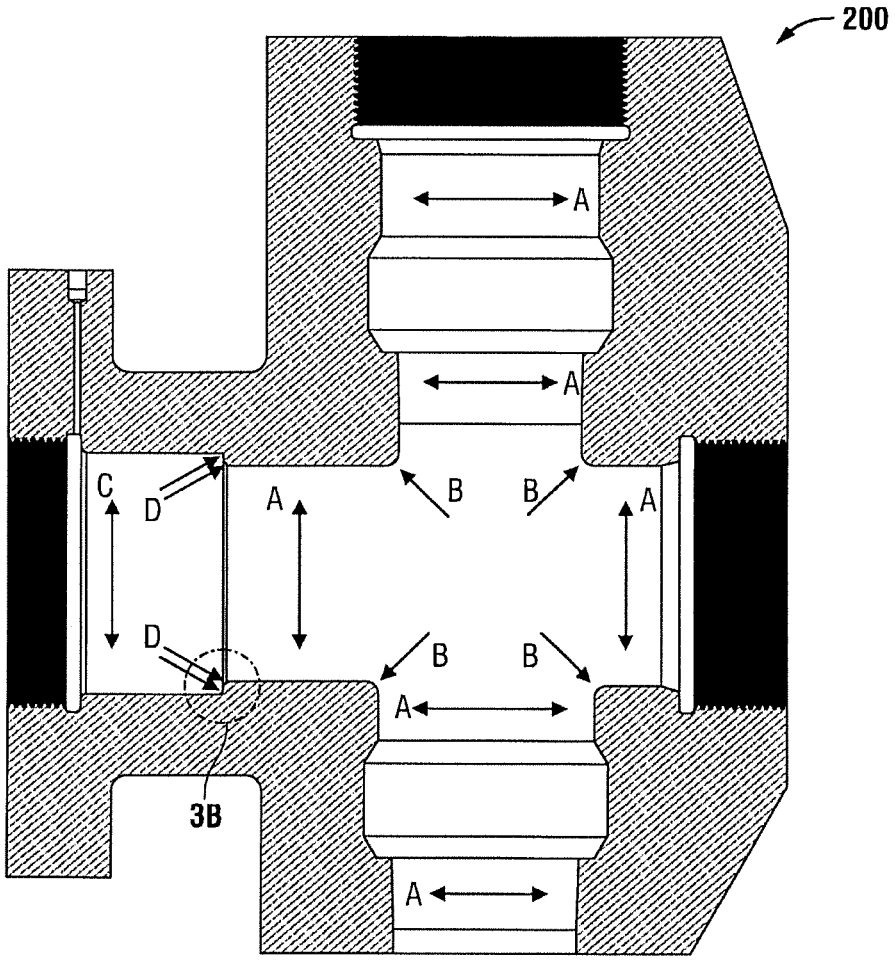
FIGS. 3A and 3B illustrate section views of a hydraulic fracturing pump fluid end, and specifically, shot peening locations in the hydraulic fracturing pump fluid end.

FIG. 3A illustrates a section view of an exemplary hydraulic fracturing pump 200 with arrows pointing to various internal locations that may be shot peened using the tools disclosed herein. However, while FIG. 3A illustrates an exemplary hydraulic fracturing pump, the same advantages described herein may be realized in any other types of pumps that experience stress corrosion cracking failures or fatigue failures. The shot diameters may depend on specific areas or locations to be worked within the pump. Arrows "A" are directed to exemplary internal bores of the hydraulic fracturing pump 200 that may be shot peened. Similarly, arrows "C" are directed to an internal bore in a fluid end of the hydraulic fracturing pump 200 that may be shot peened. In one example, the internal bores may be shot peened using different shot diameter combinations, which provide greater compressive stresses beneath the internal bore surface in conjunction with a smoother internal bore surface. In one example, larger shot diameter ranging between 50 mils (1.27 mm) and 10 mils (2.54 mm) in one embodiment, or between 60 mils (1.524 mm) and 90 mils (2.286 mm) in another embodiment, or between 70 mils (1.778 mm) and 80 mils (2.032 mm) in yet another embodiment, may be used to create the deepest compressive stresses beneath the internal bore surface. Subsequently, smaller shot diameter ranging between 10 mils (0.254 mm) and 50 mils (1.27 mm) in one embodiment, or between 20 mils (0.508 mm) and 40 mils (1.016 mm) in another embodiment, or between 25 mils (0.635 mm) and 35 mils (0.889 mm) in yet another embodiment, may be used to smooth out the internal bore surface.

Greater compressive stresses beneath the metal surface, and thereby increased average life, may be achieved using methods disclosed herein. For example, increased compressive stresses of at least 15 ksi (103.42 MPa) may be achieved beneath the metal surface up to about 40 mils. Further, greater peened coverage over the metal surface, i.e., the number of impacts as a percentage of the surface having dimples from shot impact, may be achieved using methods disclosed herein. For example, increased peened coverage over the metal surface of at least about one hundred percent (100%), or at least about one hundred twenty-five percent (125%), or at least about one hundred fifty percent (150%), or at least about one hundred seventy-five percent (175%), or at least about two hundred percent (200%), or at least about two hundred twenty-five percent (225%), or greater, coverage may be achieved.

Arrows "B" are directed to radii formed at internal bore intersections of the hydraulic fracturing pump 200 that may be shot peened. As illustrated, a first longitudinal bore intersects a second substantially perpendicular longitudinal bore thereby forming bore intersections to which arrows "B" are directed. Internal bore intersections of the hydraulic fracturing pump may each comprise a radius greater than or equal to 20 mils (0.508 mm), or greater than or equal to 25 mils (0.635 mm), or greater than or equal to 30 mils (0.762 mm), or greater than or equal to 40 mils (1.016 mm), or up to 50 mils (1.27 mm), or up to 55 mils (1.397 mm), or up to 60 mils (1.524 mm), or up to 65 mils (1.651 mm), or greater.

Figure 3B:
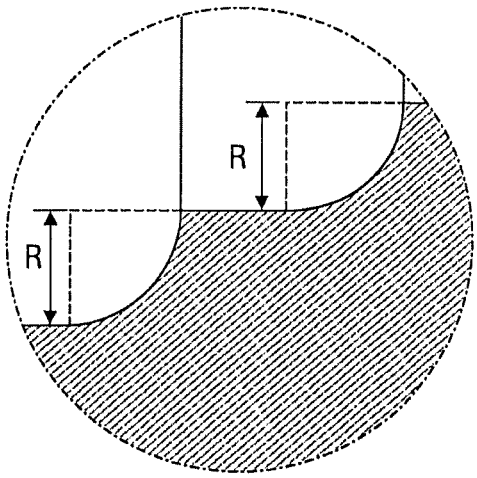

Arrows "D" are directed to a small lip within a longitudinal bore of the hydraulic fracturing pump 200. The longitudinal bore includes a small lip between a longitudinal bore portion having a first diameter and a longitudinal bore portion having a second diameter. The lip may comprise any type of geometry such as a radius, or a chamber, or a fillet, or other geometry having a radial dimension "R". FIG. 3B illustrates an enlarged section view of, in one example, radii "R" that may be shot peened. The radii "R" may be machined corner radii. Each radius "R" may be curved or straight. The radii "R" may be at least 5 mils (0.127 mm), or at least 10 mils (0.254 mm), or at least 15 mils (0.381 mm), or up to and equal to 20 mils (0.508 mm), or up to and equal to 25 mils (0.635 mm), or up to and equal to 30 mils (0.762 mm). Compressive stresses of at least 50 ksi (344.74 MPa), or at least 60 ksi (413.69 MPa), or at least 70 ksi (482.63 MPa), or at least 80 ksi (551.58 MPa), or at least 90 ksi (620.53 MPa), or at least 100 ksi (689.48 MPa), may be provided in the metal substrate beneath the radii up to about 0.001 inches (0.0254 mm), or up to about 0.002 inches (0.0508 mm), or up to about 0.003 inches (0.0762 mm).

Advantageously, shot peening in accordance with methods and tools described herein, average life and cycles to failure may be increased, and may in some cases be up to doubled. In other cases, average life and cycles to failure may be about doubled, tripled, or increased by an even greater amount by achieving the increased compressive stresses at greater depths beneath the metal surface using the disclosed methods.

Further advantageously, shot peening using the tool and related methods disclosed herein may accomplish the following: increases fatigue strength, prevents cracking due to wear, hydrogen embrittlement, corrosion and stress, enhances lubricity by creating small pores in which lubricants can accumulate, prevents fretting, prevents galling, creates a uniformly textured, finished surface ready for immediate use or for paint and coatings, curve metal or straighten shafts without creating tensile stress, permit the use of very hard steels by reducing brittleness, close up surface porosity in coatings, allow for substitution of lighter materials without sacrificing strength and durability, increase spring life 400% to 1200%, increase gear life more than 500%, increase drive pinion life up to 400%, increase crankshaft life 100% to 1000%, and increase the fatigue strength of damaged parts extending the wear and delaying replacement costs.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A method of cold-working a metal substrate within a longitudinal bore, the method comprising:

in at least one pass over a surface of the metal substrate, directing accelerated shot having diameters on average ranging between 50 mils (1.27 mm) and 100 mils (2.54 mm) toward the surface at an angle between 70 degrees and 85 degrees relative to the longitudinal bore, thereby providing increased compressive stresses in the metal substrate; and in at least one pass over the surface of the metal substrate, directing accelerated shot having diameters on average ranging between 10 mils (0.254 mm) and 50 mils (1.27 mm) toward the surface at an angle between about 70 degrees and about 85 degrees, thereby decreasing a peak-to-valley profile of the surface of the metal substrate.

2. The method of claim 1, further comprising providing a cold-working tool comprising a deflector tip configured to direct the shot toward the surface of the metal substrate.

3. The method of claim 2, wherein the deflector tip is configured to distribute the accelerated shot radially outward in a 360-degree pattern.

4. The method of claim 2, wherein the deflector tip comprises a substantially smooth radius for deflecting the shot radially outward and is configured to be rotated 360 degrees to distribute the accelerated shot radially outward in a 360-degree pattern.

5. The method of claim 1, further comprising a venturi nozzle having an abrasion resistance of at least 50 HRC and configured to accelerate the shot directed at the surface of the metal substrate.

6. The method of claim 1, further comprising providing compressive stresses of at least 15 Ksi in the metal substrate beneath the surface up to about 40 mils (1.016 mm).

7. The method of claim 1, further comprising providing peened coverage over the surface of the metal substrate of at least about one hundred percent (100%) over at least fifty percent (50%) of the surface of a lip of the longitudinal bore of the metal substrate.

8. The method of claim 1, wherein the longitudinal bore intersects a substantially perpendicular longitudinal bore thereby forming at least one bore intersection, wherein the at least one bore intersection comprises a radius greater than or equal to 30 mils (0.762 mm).

9. The method of claim 1, wherein the peak-to-valley profile of the surface of the metal substrate is less than or equal to 190 $R_a$.

10. The method of claim 1, further comprising making additional passes in different directions over the surface of the metal substrate.

* * * * *